US010851464B1

(12) United States Patent
Kobayashi et al.

(10) Patent No.: US 10,851,464 B1
(45) Date of Patent: Dec. 1, 2020

(54) METHOD FOR PRODUCING CHROMIUM PLATED PARTS, AND CHROMIUM PLATING APPARATUS

(71) Applicant: Hitachi Automotive Systems, Ltd., Ibaraki (JP)

(72) Inventors: Yuichi Kobayashi, Sagamihara (JP); Kiyokazu Nakane, Ashigarakami-gun (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 0 days.

(21) Appl. No.: 15/560,270

(22) PCT Filed: May 10, 2016

(86) PCT No.: PCT/JP2016/063834
§ 371 (c)(1),
(2) Date: Sep. 21, 2017

(87) PCT Pub. No.: WO2016/181955
PCT Pub. Date: Nov. 17, 2016

(30) Foreign Application Priority Data

May 12, 2015 (JP) ..... 2015-097272

(51) Int. Cl.
*C25D 5/18* (2006.01)
*C25D 3/10* (2006.01)
(Continued)

(52) U.S. Cl.
CPC ..... *C25D 5/18* (2013.01); *C25D 3/10* (2013.01); *C25D 5/14* (2013.01); *C25D 17/007* (2013.01); *C25D 17/16* (2013.01)

(58) Field of Classification Search
CPC ..... C25D 5/18; C25D 3/04
See application file for complete search history.

(56) References Cited

U.S. PATENT DOCUMENTS 4,092,226 A * 5/1978 Laing ..... C25D 3/10 204/DIG. 9
6,329,071 B1 * 12/2001 Kobayashi ..... C25D 3/04 205/104

(Continued)

FOREIGN PATENT DOCUMENTS

DE 39 33 896 C1 10/1990
GB 2 236 763 A 4/1991

(Continued)

OTHER PUBLICATIONS

International Search Report of PCT/JP2016/063834 dated Jun. 21, 2016.

(Continued)

*Primary Examiner* — Brian W Cohen
(74) *Attorney, Agent, or Firm* — Mattingly & Malur, PC

(57) ABSTRACT

According to the method for producing chromium plated parts, a plurality of workpieces are immersed in a chromium plating bath, a plating treatment is performed by using a pulse current, and chromium plating layers that have compressive residual stress and suppressed cracking are deposited on surfaces of the plurality of workpieces. A direct current from plating separation lower limit current density up to a range in which the chromium plating layers have compressive residual stress is superimposed during downtime of application of the pulse current.

6 Claims, 9 Drawing Sheets

(51) Int. Cl.

| | |
|---|---|
| ***C25D 5/14*** | (2006.01) |
| ***C25D 17/16*** | (2006.01) |
| ***C25D 17/00*** | (2006.01) |

(56) References Cited

U.S. PATENT DOCUMENTS

| | | | | |
|---|---|---|---|---|
| 8,173,004 | B2 * | 5/2012 | Hirasawa ..... | C25D 17/10<br>204/242 |
| 2007/0227895 | A1 | 10/2007 | Bishop et al. | |

FOREIGN PATENT DOCUMENTS

| | | | |
|---|---|---|---|
| JP | 03-207884 | A | 9/1991 |
| JP | 2000-199095 | A | 7/2000 |
| JP | 2004-300522 | | 10/2004 |
| JP | 2008-542552 | A | 11/2008 |
| JP | 2010-226065 | A | 10/2010 |
| WO | 2007/046870 | A2 | 4/2007 |

OTHER PUBLICATIONS

German Office Action received in corresponding German Application No. 11 2016 002 153.4 dated Apr. 24, 2020.

* cited by examiner (A)
(B)
(C)
1
2
3
3a
3b
5
6
7
8
9
10
15
16
17
18
18a
19
20
21
22
23
(18)
B
W
X
Y
X1
X2
X3
X4
X5
X6
X7
X8
X9
X10
Y1
Y2
Y3
Y4
Y5
Y6
Y7
Y8
Y9
Y10
W1
W2
W3
W4
W5
W6
W7
W8
W9
W10
(+)
(−)

FIG. 12

| | | Conduction time, ms | | | | | | | | | |
|---|---|---|---|---|---|---|---|---|---|---|---|
| | | 0.8 | 1 | 1.2 | 1.4 | 1.6 | 1.8 | 2 | 3 | 4 | 5 |
| Downtime, ms | 0.1 | 180 | | 163 | | | | | | | |
| | 0.2 | | | 67 | | | | | | | |
| | 0.3 | -301 | -233 | -137 | -23 | | | | | | |
| | 0.4 | | | | -145 | -105 | -77 | 2 | | | |
| | 0.5 | | | | | | -120 | -70 | | | |
| | 0.6 | | | | | | | -136 | -88 | | |
| | 0.8 | | | | | | | | -121 | -40 | |
| | 1 | | | | | | | | | -111 | -49 |
| | 1.5 | -386 | | -404 | -426 | | | | | | +105 |
| | 2 | -304 | | -412 | | | | -391 | | | |
| | 3 | -101 | -159 | -298 | | | | | -321 | | |
| | 4 | 100 | 94 | -121 | | | | | | | -150 |
| | 5 | | | 105 | 88 | 78 | 62 | 33 | -10 | -45 | -87 |

FIG. 13

| | | Conduction time, ms | | | | | | | | | |
|---|---|---|---|---|---|---|---|---|---|---|---|
| | | 0.8 | 1 | 1.2 | 1.4 | 1.6 | 1.8 | 2 | 3 | 4 | 5 |
| Downtime, ms | 0.1 | + | + | + | + | + | + | + | + | + | + |
| | 0.2 | + | + | + | + | + | + | + | + | + | + |
| | 0.3 | | | | + | + | + | + | + | + | + |
| | 0.4 | | | | | | + | + | + | + | + |
| | 0.5 | CrH | | | - 100 MPa or more | | | | + | + | + |
| | 0.6 | CrH | CrH | CrH | | | | | + | + | + |
| | 0.8 | CrH | CrH | CrH | CrH | CrH | CrH | | | + | + |
| | 1 | CrH | CrH | CrH | CrH | CrH | CrH | CrH | | + | + |
| | 1.5 | CrH | CrH | CrH | CrH | CrH | CrH | CrH | CrH | CrH | CrH |
| | 2 | CrH | CrH | CrH | CrH | CrH | CrH | CrH | CrH | CrH | CrH |
| | 3 | CrH | CrH | CrH | CrH | CrH | CrH | CrH | CrH | CrH | CrH |
| | 4 | CrH | CrH | CrH | CrH | CrH | CrH | CrH | CrH | CrH | CrH |
| | 5 | CrH | CrH | CrH | CrH | CrH | CrH | CrH | CrH | CrH | CrH |

METHOD FOR PRODUCING CHROMIUM PLATED PARTS, AND CHROMIUM PLATING APPARATUS

TECHNICAL FIELD

The present invention relates to a method for producing chromium plated parts including hard chromium plating layers formed on the surfaces thereof and to a chromium plating apparatus.

Priority is claimed on Japanese Patent Application No. 2015-097272, filed May 12, 2015, content of which is incorporated herein by reference.

BACKGROUND ART

A technology using a pulse current is known as a technology for forming a chromium plating layer with high corrosion resistance on a surface of a metal part (see Patent Literature 1). Also, a technology for forming a chromium plating layer with compressive residual stress of 100 MPa or more by using a pulse current to form a chromium plating layer that suppresses cracking is known (see Patent Literatures 2 and 3).

CITATION LIST

Patent Literature

[Patent Literature 1]
Japanese Unexamined Patent Application, First Publication No. H03-207884
[Patent Literature 2]
Japanese Unexamined Patent Application, First Publication No. 2000-199095
[Patent Literature 3]
Japanese Unexamined Patent Application, First Publication No. 2004-300522

SUMMARY OF INVENTION

Technical Problem

According to the technology described in Patent Literatures 2 and 3, occurrence of cracking is suppressed, and a chromium plating layer that exhibits excellent corrosion resistance even after undergoing a thermal history can be realized, by adjusting a compressive residual stress of the chromium plating layer to 100 MPa or more.

However, plating treatment conditions, such as conduction time and downtime, under which the compressive residual stress of the chromium plating layer can be adjusted to 100 MPa or more in the pulse current application conditions described in Patent Literatures 2 and 3 fall within a very narrow range. Also, excessively long downtime causes chromium hydride to be easily generated in the chromium plating layer, and there is a possibility that targeted compressive residual stress cannot be obtained.

When a plurality of workpieces made of a metal are immersed in a plating bath in an aligned state and chromium plating layers are formed on the surfaces of the respective workpieces, for example, it is difficult to simultaneously apply uniform electrolysis conditions to all the plurality of workpieces. Therefore, there is a possibility of chromium plating layers that have not reached targeted residual compressive stress being generated depending on installation positions of the workpieces in a case in which the allowable range of the plating treatment conditions is narrow.

According to the technology described in Patent Literatures 2 and 3, it is necessary to select a pulse current with a high frequency of 1000 Hz or more in order to form the chromium plating layers that have compressive residual stress of 200 MPa or more and crack less. Therefore, the temperature of the plating bath is raised by induction heating, and a large-scaled cooling apparatus for cooling the plating bath is required.

The present invention provides a method for producing chromium plated parts and a chromium plating apparatus capable of generating chromium plating layers that have compressive residual stress of 100 MPa or more under wider plating treatment conditions than those in the related art even if a plurality of workpieces are electrolyzed in the same bath, by superimposing a DC electric current under specific conditions during downtime of a pulse current when the chromium plating layer is formed.

Solution to Problem

According to a first aspect of the present invention, a method for producing chromium plated parts includes a process of immersing a plurality of workpieces in a chromium plating bath; a process of performing a plating treatment by using a pulse current; and a deposit process of depositing chromium plating layers, which have compressive residual stress and suppress cracking, on surfaces of the plurality of workpieces. A direct current from a plating separation lower limit current density up to a range in which the chromium plating layers have compressive residual stress is superimposed during downtime of application of the pulse current.

According to a second aspect of the present invention, the current density in which the chromium plating layers have the compressive residual stress may have a range from the plating separation lower limit current density to not more than 25 $A/dm^2$.

According to a third aspect of the present invention, the DC superimposed current density may have a range from 10 to 35 $A/dm^2$.

According to a fourth aspect of the present invention, a frequency of the pulse current may be from 100 to 700 Hz.

According to a fifth aspect of the present invention, the plurality of workpieces may be immersed in the chromium plating bath in an aligned state, and the individual workpieces may be energized by corresponding cathode electrodes and energized by anode electrodes that are individually arranged in the vicinity of the individual workpieces.

According to a sixth aspect of the present invention, a chromium plating apparatus includes a treatment tank that accommodates a chromium plating bath; cathode electrodes that energize workpieces made of a metal while the workpieces are suspended in the treatment tank; anode electrodes that are arranged in the vicinity of the workpieces that are suspended in the treatment tank; and a pulsed power supply that is connected to the cathode electrodes and the anode electrodes and applies a pulse current thereto. The pulsed power supply superimposes a direct current from a plating separation lower limit current density up to a range in which compressive residual stress is obtained, during downtime of the pulse current.

According to a seventh aspect of the present invention, the pulsed power supply may apply, to the pulse current, current density from the plating separation lower limit current density to not more than 25 A/dm$^2$ as the current density up to the range in which the compressive residual stress is obtained.

According to an eighth aspect of the present invention, the pulsed power supply may select a range from 10 to 35 A/dm$^2$ as the DC superimposed current density.

According to a ninth aspect of the present invention, the pulsed power supply may select a range from 100 to 700 Hz as a frequency of the pulse current.

According to a tenth aspect of the present invention, the plurality of cathode electrodes may be installed in the treatment tank so that a plurality of workpieces is capable of being immersed in the chromium plating bath in an aligned state. The plurality of anode electrodes may be installed to correspond to the individual workpieces in the treatment tank. The cathode electrodes may be connected to a pulsed power supply via an anode support and an anode-side bus bar. The anode electrodes may be connected to the pulsed power supply via a cathode support and a cathode-side bus bar.

Advantageous Effects of the Invention

According to the aforementioned method for producing chromium plated parts and the chromium plating apparatus, it is possible to widen ranges of choice of conduction time and downtime of a pulse current when a chromium plating treatment is performed simultaneously on a plurality of workpieces in a chromium plating bath and forming chromium plating layers with compressive residual stress of 100 MPa or more. As a result, it is possible to generate the chromium plating layers with targeted compressive residual stress with no cracking on all the plurality of workpieces.

BRIEF DESCRIPTION OF DRAWINGS

FIG. 12 illustrates results for a test conducted by superimposing the direct current on the pulse current, setting the conduction time to a range from 0.8 to 5 ms, and setting the downtime to a range from 0.3 ms to 5 ms.

FIG. 13 illustrates results for a test conducted by setting the conduction time in a range from 0.8 to 5 ms and selecting the downtime in a range from 0.1 to 5 ms.

DESCRIPTION OF EMBODIMENTS

First Embodiment

Hereinafter, a first embodiment of the present invention will be described on the basis of the embodiment illustrated in the accompanying drawings.

Figure 1:
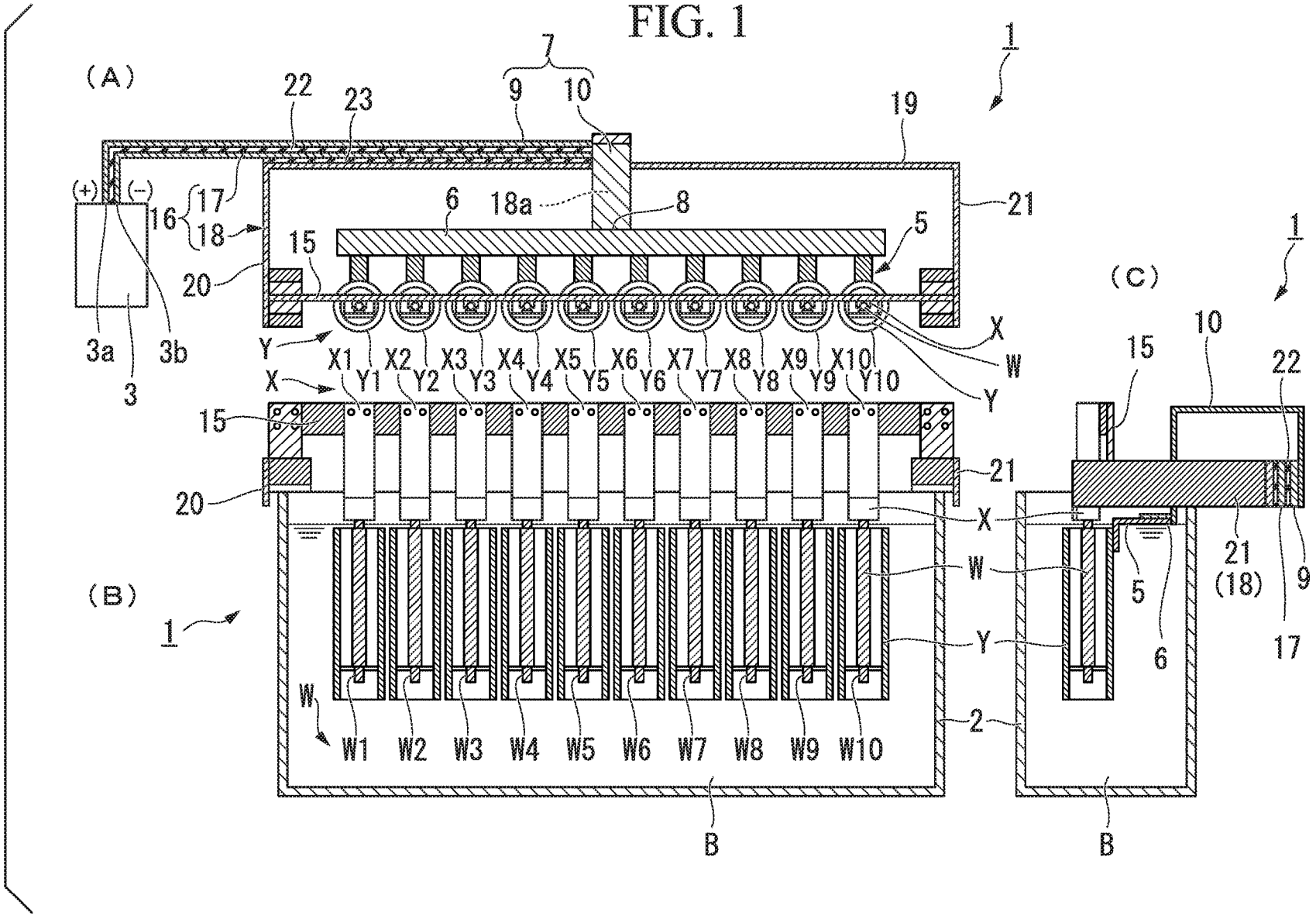
FIG. 1 is a diagram schematically illustrating an exemplification of a chromium plating apparatus that is used for performing a method for producing chromium plated parts according to an embodiment of the present invention. A part (A) of FIG. 1 is a planar sectional view. A part (B) of FIG. 1 is a vertical sectional view. A part (C) of FIG. 1 is a side sectional view.

FIG. 1 is a sectional view illustrating an exemplification of a chromium plating apparatus that is used for performing a method for producing chromium plated parts according to the first embodiment of the present invention.

A chromium plating apparatus 1 used in the embodiment includes a batch-type treatment tank 2 that accommodates a chromium plating bath B containing organic sulfonic acid and is made of an electrically insulating material. Ten workpieces W (W1 to W10) are immersed in the chromium plating bath B, and chromium plating layers that have desired compressive residual stress are deposited on surfaces of the workpieces W by using a pulse current output from a pulsed power supply 3. The number of workpieces W that can be accommodated in the chromium plating apparatus 1 is not particularly limited, and FIG. 1 illustrates one exemplification thereof. As for the number of workpieces W that can be accommodated in the chromium plating apparatus 1, generally, that the chromium plating apparatus 1 can be configured to have a scale in which ten to several tens of workpieces W, or a greater number of workpieces W can be accommodated.

In the treatment tank 2, a plurality of tubular anode electrodes Y (anodes) are arranged at a predetermined interval in a line to correspond to the individual workpieces W. Cathode electrodes X with a strip shape corresponding to the respective anode electrodes Y are arranged above the respective anode electrodes Y. The respective workpieces W are suspended and supported below the respective cathode electrodes X, and the respective workpieces W are immersed in the chromium plating bath B.

The respective workpieces W are arranged to be inserted into the tubular anode electrodes Y and face inner circumferential walls of the anode electrodes Y.

Hereinafter, the plurality of anode electrodes Y will appropriately be referred to as first, second, . . . , and tenth anode electrodes Y1, Y2, . . . , and Y10 in order from the left side in a part (A) of FIG. 1 as necessary. Also, the plurality of cathode electrodes X will appropriately be referred to as first, second, . . . , and tenth cathode electrodes X1, X2, . . . , and X10 in order from the left side in a part (B) of FIG. 1 as necessary.

The anode electrodes Y are connected to a plate-shaped anode support 6 via hook members 5 that are arranged at equal intervals as shown in the part (A) and a part (C) of FIG. 1. The anode support 6 is connected, at the center in the longitudinal direction thereof, to a positive terminal 3*a* of the pulsed power supply 3 via an anode-side bus bar 7. Hereinafter, the connection point will be referred to as a power supply point 8. The anode-side bus bar 7 has an anode-side bus bar main body 9 with a substantially L-shaped plate shape that has one end connected to the positive terminal 3*a* of the pulsed power supply 3, and an anode-side bus bar extension plate 10 that has one end connected to the other end of the anode-side bus bar main body 9. The other end of the anode-side bus bar extension plate 10 is connected to the power supply point 8 of the anode support 6.

The cathode electrodes X are connected to a plate-shaped cathode support 15 that is arranged above the treatment tank 2 as shown in the part (B) and the part (C) of FIG. 1. The cathode support 15 is connected, at both ends thereof, to a negative terminal 3*b* of the pulsed power supply 3 via a cathode-side bus bar 16. The cathode-side bus bar 16 is formed of a cathode-side bus bar main body 17 with a substantially L-shaped plate shape that has one end connected to the negative terminal 3*b* of the pulsed power supply 3, and a cathode-side bus bar extension portion 18 with substantially a U shape that is connected to the other end of the cathode-side bus bar main body 17.

The cathode-side bus bar extension portion 18 is configured of a plate-shaped extension portion main body 19 and orthogonal plates that are orthogonally coupled to both ends of the extension portion main body 19. A first orthogonal plate 20 and a second orthogonal plate 21 are connected to the ends of the cathode support 15. Hereinafter, the orthogonal plate on the left side in the part (A) and the part (B) of FIG. 1 will be referred to as the first orthogonal plate 20, and the orthogonal plate on the right side in the part (A) and the part (B) of FIG. 1 will be referred to as the second orthogonal plate 21 for convenience.

The anode-side bus bar main body 9 and the cathode-side bus bar main body 17 are arranged to overlap at the closest positions to the maximum extent via an insulating member 22. The anode-side bus bar main body 9 and the cathode-side bus bar main body 17 are formed to have a small inductance value with a flow of an electric current in the opposite directions. Also, a portion of the extension portion main body 19 on the side of the first orthogonal plate 20 is connected to the other end side of the cathode-side bus bar main body 17 via an insulating member 23.

A pulse current supplied from the pulsed power supply 3 is supplied to the power supply point 8 through the anode-side bus bar 7, passes through the anode support 6, and is supplied to the anode electrodes Y (first, second, . . . , and tenth anode electrodes Y1, Y2, . . . , and Y10) arranged in the treatment tank 2. Furthermore, the pulse current forms plating layers on the respective workpieces W via the plating bath B, flows to the cathode electrodes X (first, second, . . . , and tenth cathode electrodes X1, X2, . . . , and X10) through the workpieces W, and returns to the pulsed power supply 3 through the cathode-side bus bar 16. In such a process of the flow of the pulse current, the electric current that has been supplied to the power supply point 8 is branched into the respective anode electrodes Y from the power supply point 8 and flows through the respective workpieces W. Then, the electric current that has flowed through the respective workpieces W flows toward both end sides of the cathode support 15.

Since hard metal films (chromium layers) with low frictional coefficients can be obtained by chromium plating in general, the chromium plating has widely been used as industrial chromium plating for parts that require wear resistance.

However, there is a possibility of much cracking that reaches a metal base occurring in chromium layers obtained by general-purpose hard chromium plating, and of a medium that may become a factor of corrosion if nothing is made reaching the metal base, causing corrosion, and in a case in which steel is the metal base, causing rust.

Although the chromium plated parts are typically used after the surfaces thereof are formed into a smooth state by performing polishing such as buffing after the plating treatment, there are cases in which plastic flow occurs on the surfaces of chromium layers, and the cracking is blocked during the polishing. Therefore, the general-purposed plated parts are typically used after performing polishing without a special rust-proofing treatment.

However, there are cases in which the cracking opens due to contraction or the like of the chromium layers depending on thermal histories thereafter in some cracking blocking structures caused by the plastic flow in the chromium layers, and there is a possibility of corrosion resistance being degraded in parts that are used in a high-temperature environment above ordinary temperatures.

Therefore, a technology for attempting to obtain chromium layers with no cracking by supplying a pulse current during chromium plating is known in the related art. However, there is a possibility that if pulse plating is simply performed, tensile stress remains in the chromium layers and large cracking occurs in the chromium layers in response to the thermal histories.

According to the chromium plating technology described in Patent Literature 2, occurrence of new cracking can be suppressed regardless of the thermal history by forming the chromium plating layers while adjusting a waveform of the pulse current and applying compressive residual stress of 100 MPa or more to the chromium layers. However, according to the technology described in Patent Literature 2, values of compressive residual stress of the obtained chromium layers greatly vary in the same processing lot if batch processing of chromium plating is performed in a plating bath, and it is difficult to stably obtain the chromium plating layers with the compressive residual stress of 100 MPa or more.

In the embodiment, the pulse current is adjusted as follows for the purpose of achieving manufacturability without causing any problems even when the chromium plating layers that have the compressive residual stress of 100 MPa or more and cause no cracking are manufactured by simultaneously performing an electrolysis treatment on the many workpieces W using the chromium plating apparatus 1 illustrated in FIG. 1.

In the first embodiment, the chromium plating apparatus 1 is used to immerse the workpieces W in the plating bath B containing organic sulfonic acid and perform a plating treatment using a pulse current (hereinafter, this will be referred to as a pulse plating treatment). Here, the electric current pattern as shown in FIG. 2 can be employed as a condition of the pulse plating treatment.

Figure 2:
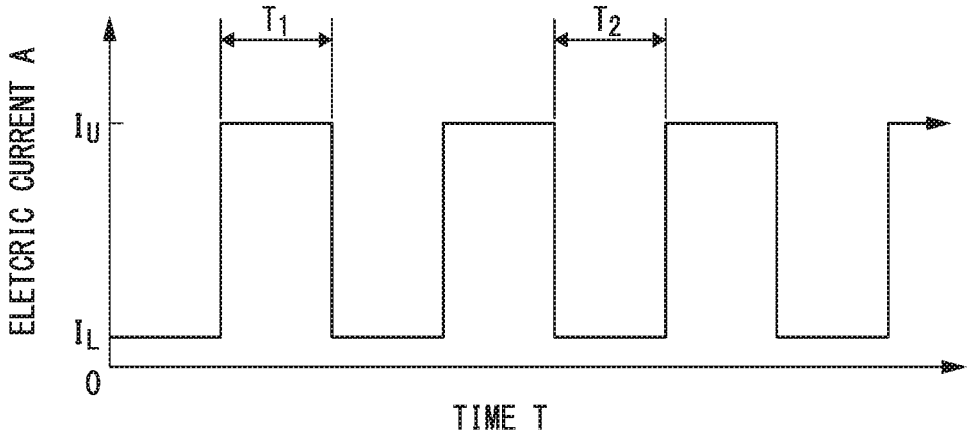
FIG. 2 is a graph illustrating an exemplification of a pulse current waveform that is used in the production method according to the embodiment of the present invention.

In FIG. 2, a waveform of the pulse current alternates between a maximum current density IU and a minimum current density IL, the maximum current density L1 is maintained for a predetermined time, for example, $T_1$ hours, and the minimum current density is maintained for a predetermined time, for example, $T_2$ hours, is employed.

The minimum current density IL is set between a plating separation lower limit current density and a current density up to a range in which the compressive residual stress can be applied to the chromium plating layer in this embodiment. The maintaining time $T_1$ may be set to the same value or different values.

Figure 3:
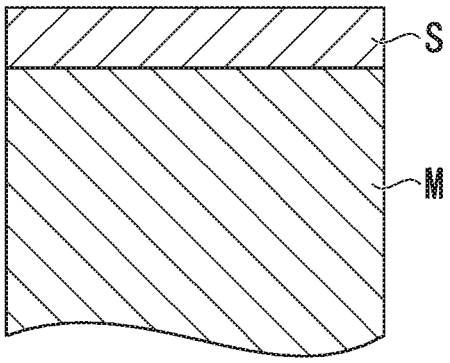
FIG. 3 is a partial sectional view illustrating a state of a surface layer portion of a chromium plated part that is obtained by the production method according to the embodiment of the present invention.

In the embodiment, the pulse plating treatment is performed by applying the pulse current while setting the maximum current density IU, the minimum current density IL, and the maintaining time $T_1$ and $T_2$ during which such current density is maintained to appropriate values, and chromium plating layers S that have desired compressive residual stress and suppress cracking are deposited on the surfaces of steel base materials (workpieces W) as shown in FIG. 3. Here, the compressive residual stress of 100 MPa or more (100 MPa to 400 MPa, for example) is applied to the chromium plating layers S.

In the embodiment, a range from 50 to 300 A/dm$^2$ or more preferably from 60 to 250 A/dm$^2$, for example, can be selected as the maximum current density of the pulse current applied.

In the embodiment, a range from 10 to 35 A/dm$^2$ or more preferably from 15 to 20 A/dm$^2$ can be selected as the minimum current density IL of the pulse current applied. As the minimum density IL, a plating separation lower limit value when electrolysis is performed, for example, within a range from 10 to 15 A/dm$^2$, can be selected. Although the lower limit value differs depending on the plating bath, a range from about 10 to 15 A/dm$^2$ can be selected.

In the embodiment, a range from 100 to 700 Hz or more preferably a range from 100 to 500 Hz, for example, can be selected as the frequency of the pulse current applied. If the frequency of the pulse current applied exceeds 700 Hz, the bath temperature of the plating bath B rises, and introduction of a cooling apparatus for the plating bath B is needed, which requires larger-scaled equipment. If the frequency is less than 100 Hz, the compressive residual stress values of the chromium plating layer S that can be generated tend to decrease.

In the embodiment, a duty ratio of the pulse current applied is preferably equal to or less than 80%. The duty ratio (Dy) is represented as Dy=T1/T on the basis of a relationship between the pulse width (T1) and the frequency (T) of the pulse wave.

In the embodiment, it is necessary that the downtime of the pulse current be set to be 0.5 ms or more.

In a case in which the downtime of the pulse current is as short as less than 0.5 ms, chromium plating layers containing CrH are not formed by hydrogen (H) in a generation stage of bonding to a chromium (Cr) atom even if the direct current is not superimposed. However, if the downtime is longer, hydrogen in the generation stage tends to bond to chromium, and the probability of the chromium plating layers containing CrH being obtained becomes higher. Therefore, it is important to superimpose the direct current on the pulse current in the case in which the downtime of the pulse current exceeds 0.5 ms as follows.

In relation to the direct current to be superimposed during downtime of the pulse current, the downtime can be selected in a range from 0.3 ms to 5 ms in a case in which the conduction time of the pulse current is in a range from 0.8 ms to 5 ms in the embodiment.

For example, in a case in which the conduction time is 0.8 ms, the downtime can be selected in a range from 0.3 ms to 3 ms. In a case in which the conduction time is 1.0 ms, the downtime can be selected in a range from 0.3 ms to 3 ms. In a case in which the conduction time is 1.2 ms, the downtime can be selected in a range from 0.3 ms to 4 ms.

For example, in a case in which the conduction time is 1.4 ms, the downtime can be selected in a range from 0.4 ms to 4 ms. In a case in which the conduction time is 1.6 ms, the downtime can be selected in a range from 0.4 ms to 4 ms. In a case in which the conduction time is 1.8 ms, the downtime can be selected in a range from 0.5 ms to 4 ms. In a case in which the conduction time is 2.0 ms, the downtime can be selected in a range from 0.6 ms to 4 ms.

For example, in a case in which the conduction time is 3.0 ms, the downtime can be selected in a range from 0.8 ms to 3 ms. In a case in which the conduction time is 4.0 ms, the downtime can be selected in a range from 1.0 ms to 4 ms. In a case in which the conduction time is 5.0 ms, the downtime can be selected in a range from 1.5 ms to 4 ms.

The plating bath B that is used when the chromium plating layers are formed by using the pulse current under the aforementioned conditions is a plating bath that includes chromic acid and sulfate radicals ($SO_4^{2-}$) and organic sulfonic acid in one example. For example, the plating bath B that includes the sulfate radicals with concentration ranging from 2 to 8 g/L or preferably ranging from 3 to 7 g/L can be used.

Under the electrolysis condition in the related art in which the direct current is not superimposed during the downtime of the pulse current, if the sulfate radical density ($SO_4^{2-}$) in the plating bath exceeds 6.0 g/L, it is difficult to deposit the chromium plating layers that have the compressive residual stress of 100 MPa or more, and management of the plating bath becomes complicated. In contrast, if the pulse current with the direct current superimposed thereon is used under the aforementioned conditions, it is possible to deposit the chromium plating layers that have the compressive residual stress of 100 MPa or more, or further, the compressive residual stress of 200 MPa or more even in the sulfate radical density in the range from 6 to 8 g/L. Also, it is possible to generate the chromium plating layers S that also exhibit high compressive residual stress in the 400 MPa level depending on conditions.

When a chromium plating layer is formed on only one workpiece W by using one pulsed power supply in the plating treatment apparatus, it is possible to reliably apply the compressive residual stress that is as high as 100 MPa or more to the generated chromium plating layer in accordance with the setting of the pulse current. However, when a plurality of workpieces W are immersed in the plating bath B in an aligned state and a plating treatment is performed thereon as shown in FIG. 1, there is a possibility of the downtime and the conduction time of the pulse current not being realized as designed depending on positions of the workpieces W in the plating bath. When forty workpieces W are immersed in the plating bath B, for example, this tendency significantly appears.

If the downtime is shorter than the designated downtime, the residual stress of the chromium plating layers tends to approach the tensile side. If the downtime is longer than the designed downtime, Cr and H bond to each other as described above, and Cr plating layers containing CH tend to be generated. However, if the electrolysis is performed by using the pulse current with the direct current superimposed thereon under the aforementioned conditions, it is possible to reduce the probability of Cr and H bonding to each other with respect to the length of the downtime and to thereby prevent bonding between Cr and H.

In addition, it is possible to achieve an effect in which the amount of shift of the residual stress of the chromium plating layers S toward the tensile side, which accompanies an increase in the negative ion concentration in the plating bath B, to be not more than ⅕ of that when electrolysis is performed with the pulse current with no direct current superimposed thereon or less. This is because the workpieces W can be maintained in a negative potential and negative ions (sulfate radicals, in particular) in the vicinity of the surfaces of the workpieces W can be repelled by applying the direct current to the workpieces W even during the downtime of the pulse electrolysis.

Since the chromium plated parts obtained by performing the plating treatment while the pulse current with the direct current superimposed thereof is applied during the downtime on the basis of the aforementioned conditions include the chromium plating layer S with no cracking, a medium that may become a factor of corrosion does not reach the metal base of the steel base material M, and desired corrosion resistance is secured.

Furthermore, since the chromium plating layers S have high compressive residual stress, new cracking is not caused even after undergoing thermal histories, and excellent corrosion resistance is maintained.

The chromium plating apparatus 1 according to the first embodiment is formed such that the inductance of wiring between adjacent anode electrodes Y and the inductance of wiring between adjacent cathode electrodes X become sufficiently small. Setting is made such that the inductances become equivalent. Also, a pulse current that is as uniform as possible is made to flow through the respective workpieces W.

If the aforementioned maximum current density IU, minimum current density IL, and maintaining time $T_2$ during which the minimum current density is maintained are set to the aforementioned appropriate ranges, it is possible to form the chromium plating layers S that have the compressive residual stress of 100 MPa or more and cause no cracking even in mass production using the batch-type treatment tank 2.

Here, a reason for which residual stress caused in chromium plating layers becomes compressive stress when the chromium plating layers are formed by electrolysis using the pulse current illustrated in FIG. 2 in the aforementioned ranges will be described.

Chromium atoms deposited on the surfaces of the workpieces W during the conduction time of the pulse current are actively diffused on the surfaces of the workpieces even during the downtime of the pulse current, meet other chromium atoms, and form crystals. Crystal grain boundaries in the chromium plating layers become incommensurate, and vacancies are generated at the crystal grain boundaries. Chromium atoms that have not found locations to reside and are actively diffused on the surfaces of the workpieces during the downtime of the pulse current reach the vacancies at the incommensurate crystal grain boundaries and can fill the vacancies.

Since there is a relationship of (activation energy of surface self-diffusion>formation energy of atoms that invade and break into the vacancies at the crystal grain boundaries) in a case in which less energy is required for the chromium atoms to enter the vacancies than to be diffused on the surfaces of the workpieces W even if the interatomic spacing at the vacancies is too narrow for one chromium atom to enter, the chromium atoms are considered to invade and break into the vacancies, and as a result, the compressive stress increases.

The reason that the compressive residual stress can be obtained in the wider range of downtime than that in the related art by superimposing the direct current during the downtime of the pulse current is considered on the basis of this consideration as follows.

In a case in which no direct current is superimposed on the pulse current, there is a possibility of the chromium atoms that move on the surface of the work pieces W bonding to hydrogen (H) in the generation stage during the downtime. However, the workpieces W made of a metal are maintained in a slightly negative potential even during the downtime by superimposing the direct current on the pulse current, and generation of the hydrogen atoms constantly continues.

Therefore, the energy required for the reaction in which hydrogen atoms bond to each other to form hydrogen molecules are separated from a reaction interface is considered to be less than the energy required for the reaction in which the chromium atoms bonds to the hydrogen (H) in the generation stage to form chromium hydride (CrH). Therefore, the chromium atoms generated during the conduction time of the pulse current do not bond to the hydrogen (H) in the generation stage and the chromium atoms can freely invade and break into the incommensurate grid defects (vacancies). Therefore, it is considered to be possible to generate the chromium plating layer with high compressive residual stress values in a wide range of downtime in the electrolysis using the pulse current.

If the chromium plating layers are formed by using the pulse current with the DC superimposed thereon under the aforementioned conditions, it is possible to lower the frequency below the frequency that is as high as 1000 Hz or more, which can be achieved by the technology described in Patent Literatures 2 and 3. Therefore, it is possible to reduce the number of times the pulse current is switched and to thereby correspondingly suppress the temperature rise in the plating bath B.

If the electrolysis is performed by using the pulse current with the direct current superimposed thereon under the aforementioned conditions, it is possible to select wider electrolysis conditions than those in the related art that enables the conditions that are insensitive to a direction in which the conduction time is lengthened but are sensitive to a direction in which the downtime is lengthened when the pulse current is applied in the related art to be less sensitive to the downtime than in the related art, as the duty ratio for achieving the compressive residual stress.

Therefore, it is possible to achieve the effect that the compressive residual stress exceeding 100 MPa can be applied to all the workpieces when the chromium plating layers S are formed by simultaneously performing electrolysis on many workpieces W in the batch-type treatment tank 2.

According to the chromium plating apparatus 1 capable of treating a plurality of workpieces W, it is difficult to set completely uniform conduction conditions for the individual workpieces W since slight changes in impedance and changes in a conduction state of the plating bath B occur if the pulse current is applied regardless of how the impedance and a structure of a conductive connection portion are contrived by arranging a conductive path between the pulsed power supply 3 and the workpieces W. With regard to this point, the selectability of wide pulse current conduction conditions as described above results in the effect that the compressive residual stress exceeding 100 MPa can be reliably applied to all the workpieces even if the conduction conditions for the individual workpieces W slightly differ during the plating treatment. Accordingly, the technology of the embodiment greatly contributes to plants in which the plating treatment is performed on a large amount of workpieces W.

Figure 4:
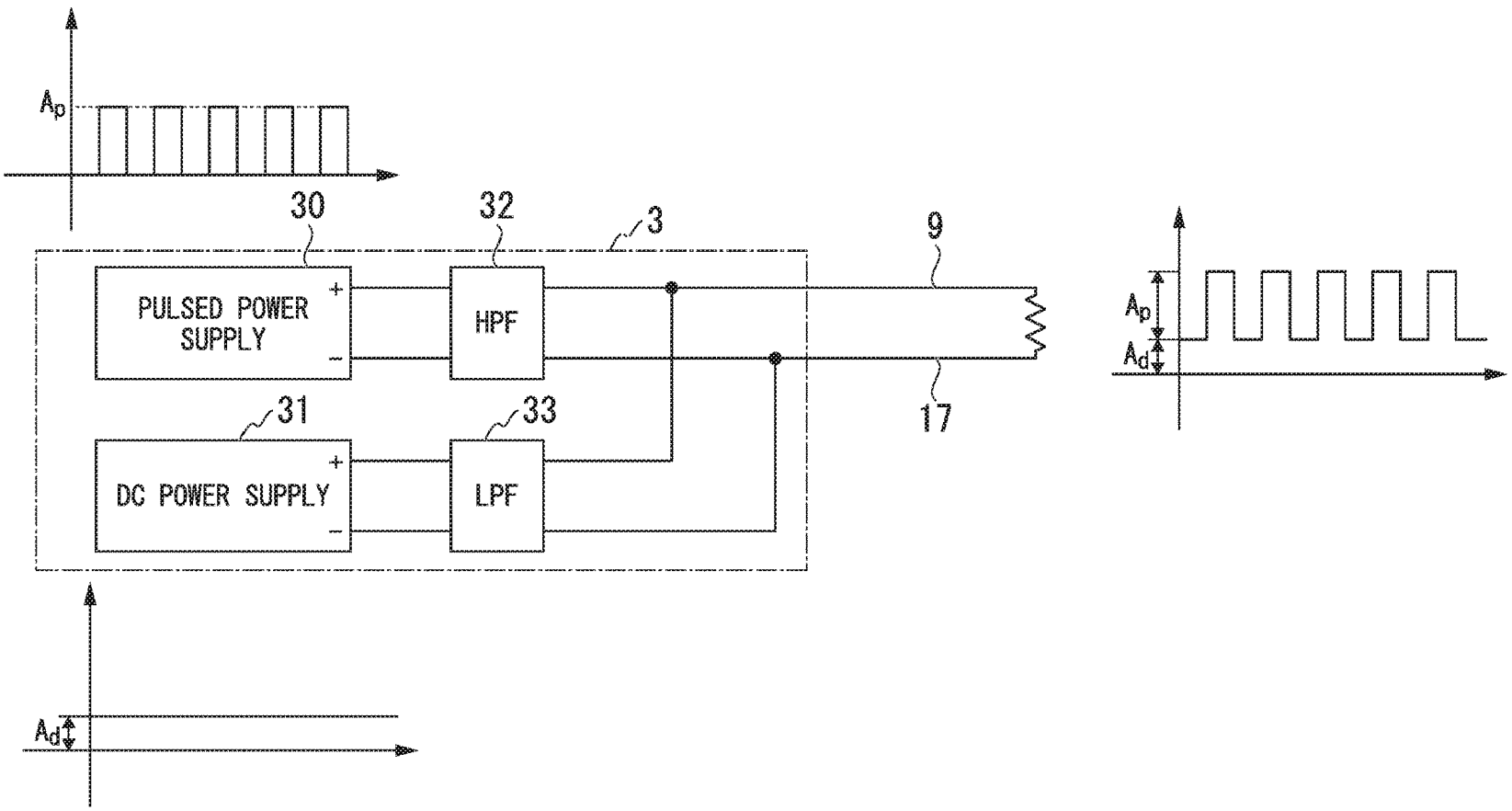
FIG. 4 is a circuit diagram illustrating an exemplification structure of a pulsed power supply that is used when the production method according to the embodiment of the present invention is performed.

In the aforementioned plating treatment apparatus 1, a configuration of combining a pulsed power supply device 30, a DC power supply device 31, a high-pass filter 32, and a low-pass filter 33 as in the configuration shown in FIG. 4 can be employed as an exemplification of the pulsed power supply 3 that is made to generate an electric current pattern shown in FIG. 2.

As shown in FIG. 4, the pulsed power supply device 30 and the DC power supply device 31 are connected in parallel to obtain a configuration in which an output from the pulsed power supply device 30 can be output via the high-pass filter 32, and an output from the DC power supply device 31 can be output via the low-pass filter 33.

It is configured that the output from the pulsed power supply device 30 passes through the high-pass filter 32 that allows only a pulse waveform to pass therethrough and the output from the DC power supply device 31 passes through the low-pass filter 33 that allows only a DC waveform to pass therethrough, and both the outputs are then synthesized and output. A pulse waveform shape that prevents reverse flow of mutual electric currents is adjusted by the pulsed power supply device 30, and the DC current which is to be superimposed on the pulse waveform is adjusted by the DC power supply device 31.

FIG. 4 shows pulse current waveforms of the output from the pulsed power supply device 30 and the output from the DC power supply device 31 after the direct current is superimposed on the pulse currents.

It is possible to output the pulse currents with the direct current superimposed thereon during the downtime of the application of the pulse currents and to achieve the object in the plating treatment apparatus 1 shown in FIG. 1 by applying the circuit shown in FIG. 4.

EXAMPLES

An example of the present invention will be described below.

Round bars with a size of ϕ12.5 mm (quenched and tempered material in accordance with JIS Standard S25C) were used as workpieces. The workpieces were immersed in a plating bath containing chromic acid (308 g/L), sulfate radicals ($SO_4^{2-}$) at 3.0 g/L, and organic sulfonic acid at 6.0 g/L. In the plating bath, the peak current density of the pulse electrolysis was set to 210 A/dm$^2$, the bath temperature was set to 75° C., the pulse conduction time was set to 0.8 to 10.0 ms, the downtime was set to 0.1 to 10.0 ms, and the superimposed current density was set to either 0 A/dm$^2$ or 16 A/dm$^2$, and chromium plating layers with thicknesses of 20 μm in which cracking was suppressed were deposited on the surfaces of the workpieces.

Figure 5:
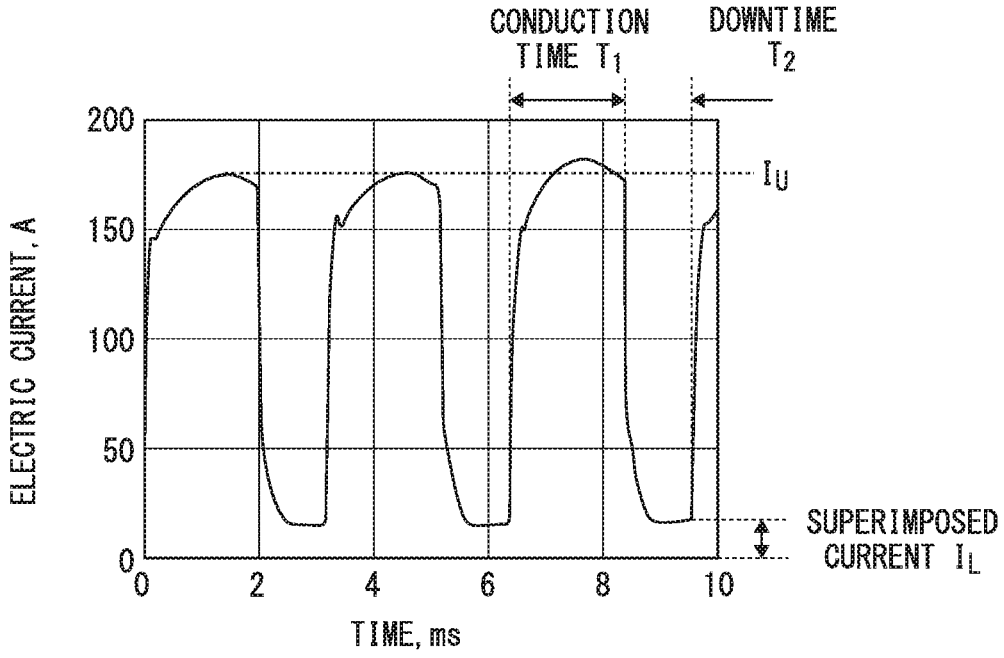
FIG. 5 is a graph illustrating an exemplification of a pulse current waveform that is used in a method of producing chromium plated parts in an example of the present invention.

FIG. 5 shows an exemplification of a pulse current waveform with a direct current superimposed thereon. The pulse current waveform illustrated in FIG. 5 is a pulse current waveform when the conduction time was set to 2 ms, the downtime was set to 0.6 ms, and the superimposed current density was 16 A/dm$^2$.

Figure 6:
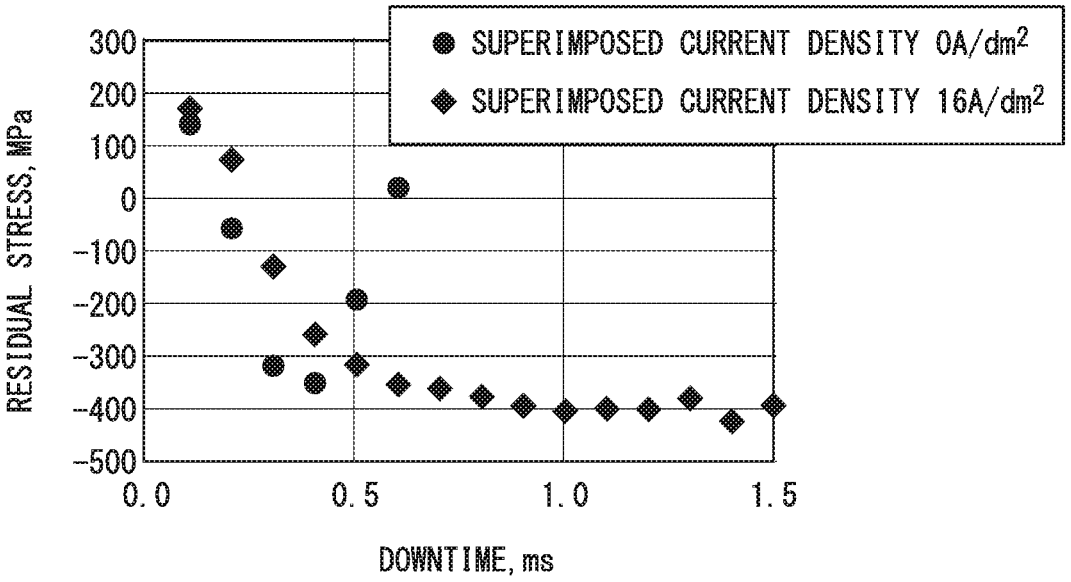
FIG. 6 is a graph illustrating an exemplification of a relationship between downtime that is employed when the chromium plated parts in the example are produced and residual stress.

FIG. 6 shows a relationship between a residual stress value and downtime of the pulse current for chromium plating layers obtained in a case in which the chromium plating treatment was performed while the conduction time was set to 1.2 ms, the downtime was set to 0.1 to 1.5 ms, and the superimposed current density was set to either 0 A/dm$^2$ or 16 A/dm$^2$ in the chromium plating treatment conditions within the aforementioned ranges.

It can be seen that, in the case in which the superimposed current density was set to 0 A/dm$^2$, that is, in the case in which the chromium plating treatment was performed by using the pulse current with no electric current superimposed thereon during the downtime as shown in FIG. 6, the residual stress values of the chromium plating layers are values of −100 MPa or more (−100 MPa to −350 MPa, for example), which fall within a range of the pulse downtime from 0.3 to 0.5. The width of the pulse downtime is considerably narrow.

In contrast, in the case in which the superimposed current density was set to 16 A/dm$^2$, that is, in the case in which the chromium plating treatment was performed by using the pulse current with the electric current superimposed thereon during the downtime, the compressive residual stress values of −137 MPa, which exceeds −100 MPa, were achieved at 0.3 ms, and high compressive residual stress values of about −250 to −400 MPa were shown even when the downtime was successively increased to 1.5 ms. That is, it was possible to greatly widen the range of choice of the downtime of the pulse current.

When the chromium plating treatment was performed by using the pulse current with no electric current superimposed during the downtime as shown in FIG. 6, the residual compressive stress increased as the downtime lengthened, and after one peak was reached, the stress value was turned to the direction toward the tensile stress.

Under a condition of an excessively long downtime, chromium plating layers with chromium hydride (CH) mixed therein were generated. This is considered to be because shortage of supply of chromium atoms (Cr atoms) from the chromium plating bath due to the excessively long downtime caused bonding between deposited Cr atoms and hydrogen (H) in the generation stage and generated CrH since a large amount of hydrogen (H) in the generation stage generated in the electrolysis was present in the vicinity of the plating surfaces.

Next, residual stress values of obtained chromium plating layers were measured for both the case in which the chromium plating layers were formed by performing electrolysis by using the pulse current with superimposed current density set to 16 A/dm$^2$ and the case in which the chromium plating layers were formed by performing electrolysis by using the pulse current with superimposed current density set to 0 A/dm$^2$ on the basis of the aforementioned test conditions as shown in FIGS. 12 and 13. The conduction time and the downtime of the pulse current were adjusted as the combinations shown in FIGS. 12 and 13 during the electrolysis. The sections with the description CrH in FIG. 13 indicate that the chromium plating layers containing CrH were generated.

As shown in FIG. 12, the test was conducted by superimposing the direct current on the pulse current, setting the conduction time to a range from 0.8 to 5 ms, and setting the downtime to a range from 0.3 ms to 5 ms. In FIGS. 12 and 13, the stress values on the side of the compressive residual stress are represented by negative values while the stress values on the side of the tensile residual stress are represented by positive values.

It was found from FIG. 12 that the downtime was able to be selected in a range from 0.3 ms to 3 ms in a case in which the conduction time was 0.8, the downtime was able to be selected in a range from 0.3 ms to 3 ms in a case in which the conduction time was 1.0 ms, and the downtime was able to be selected in a range from 0.3 ms to 4 ms in a case in which the conduction time was 1.2 ms in order to obtain the compressive residual stress values of 100 MPa or more.

It was also found that the downtime was able to be selected in a range from 0.4 ms to 4 ms in a case in which the conduction time was 1.4 ms, the downtime was able to be selected in a range from 0.4 ms to 4 ms in a case in which the conduction time was 1.6 ms, the downtime was able to be selected in a range from 0.5 ms to 4 ms in a case in which the conduction time was 1.8 ms, and the downtime was able to be selected in a range from 0.6 ms to 4 ms in a case in which the conduction time was 2.0 ms in order to obtain the compressive residual stress values of 100 MPa or more.

It was also found that the downtime was able to be selected in a range from 0.8 ms to 4 ms in a case in which the conduction time was 3.0 ms, the downtime was able to be selected in a range from 1.0 ms to 4 ms in a case in which the conduction time was 4.0 ms, and the downtime was able to be selected in a range from 1.5 ms to 4 ms in a case in which the conduction time was 5.0 ms in order to obtain the compressive residual values of 100 MPa or more. These regions are represented by the hatching in FIG. 12.

According to the test results shown in FIG. 13, the test was conducted by setting the conduction time in a range from 0.8 to 5 ms and selecting the downtime in a range from 0.1 to 5 ms, and electrolysis was performed by using a pulse current with no direct current superimposed thereon.

It was found from the results shown in FIG. 13 that the downtime was able to be selected in a range from 0.3 ms to 0.4 ms in a case in which the conduction time was 0.8 ms, the downtime was able to be selected in a range from 0.3 ms to 0.5 ms in a case in which the conduction time was 1.0 ms or 1.2 ms, and the downtime was able to be selected in a range from 0.4 ms to 0.6 ms in a case in which the conduction time was 1.4 ms or 1.6 ms in order to obtain the compressive residual stress values of 100 MPa or more.

It was also found that the downtime was able to be selected in a range from 0.4 ms to 0.5 ms in a case in which the conduction time was 1.8 ms, the downtime was able to be selected in a range from 0.5 to 0.8 s in a case in which the conduction time was 2 ms, and the downtime was able to be selected in a range from 0.8 to 1 ms in a case in which the conduction time was 3 ms in order to obtain the compressive residual stress values of 100 MPa or more. These regions are represented by the hatching in FIG. 13.

It was found from the comparison between the results shown in FIGS. 12 and 13 that it was possible to obtain the residual compressive stress values of 100 MPa or more in a wider range of downtime and in a wider range of conduction time by forming the chromium plating layers while the direct current was superimposed during the downtime of the pulse current.

It is important to be able to obtain the chromium plating layers with higher residual compressive stress values in a wide range as shown in FIG. 12 for forming the chromium plating layers with the residual compressive stress values on all the workpieces in the case in which many workpieces are immersed in the plating bath and the plating treatment is performed thereon.

In a case in which many workpieces W are accommodated in the plating bath B shown in FIG. 1 and plating is performed thereon by using a pulse current, for example, there is a possibility of large variations occurring in the residual compressive stress values depending on the workpieces since it is difficult to apply the pulse current while maintaining the downtime from 0.2 to 0.3 ms for all the workpieces W as shown in FIG. 13. Meanwhile, it was found to be possible to form the chromium plating layers with the compressive stress values of 100 MPa or more in a considerably wide range of downtime as shown in FIG. 12 by using the pulse current with the direct current superimposed thereon, and to thereby obtain the effect in which the chromium plating layers with high compressive residual stress values are able to be obtained for all the work pieces even if the plating treatment is performed on the many workpieces W in the one plating bath B.

Figure 7:
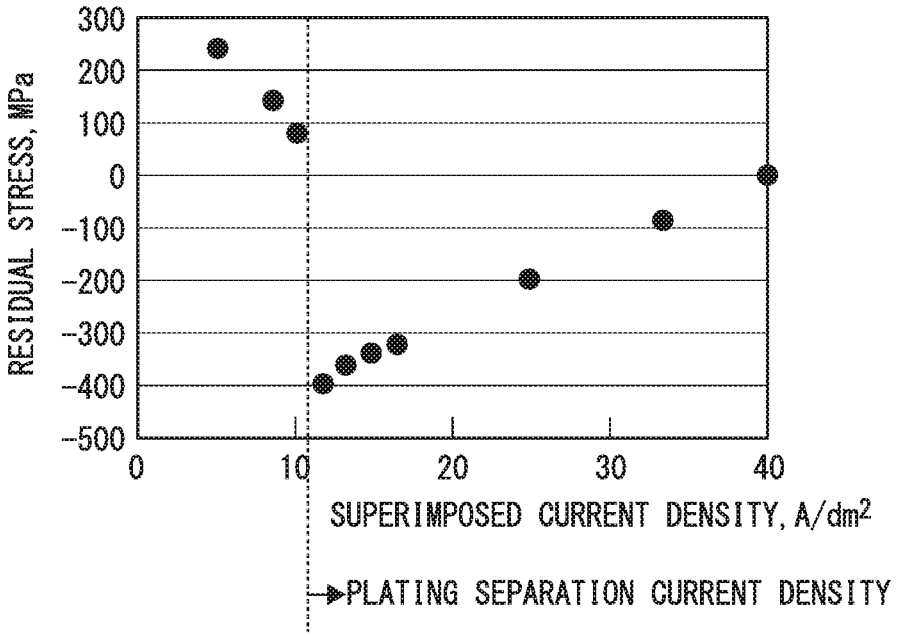
FIG. 7 is a graph illustrating an exemplification of a relationship between superimposed current density that is employed when the chromium plated parts in the example are produced and residual stress of obtained chromium plating layers.

FIG. 7 shows a result of obtaining a relationship between the current density to be superimposed on the pulse current and the residual stress values of the chromium plating layers at each superimposed current density in a case in which the conduction time of the pulse current was set to 2.0 ms and the downtime was set to 1.2 ms. In FIG. 7, the region with the indication of 0 to −500 represents the side of the compressive residual stress while the region with the description of 0 to 300 represents the side of the tensile residual stress.

It was found from the results shown in FIG. 7 that the tensile residual stress values of the chromium plating layers sequentially decreased toward 0 if the current density to be superimposed on the pulse current was made to gradually increase from 0 A/dm$^2$ to 10 A/dm$^2$, the residual stress steeply changed to the side of the compressive residual stress at a timing at which the superimposed current density reached 12 A/dm$^2$, and the chromium plating layers that exhibited the compressive residual stress values of 100 MPa or more were able to be obtained in a range from 12 to 35 A/dm$^2$. It was also found that the current density to be superimposed on the pulse current was preferably in a range from 12 to 25 A/dm$^2$ in order to obtain the compressive residual stress values of 200 MPa or more.

Figure 8:
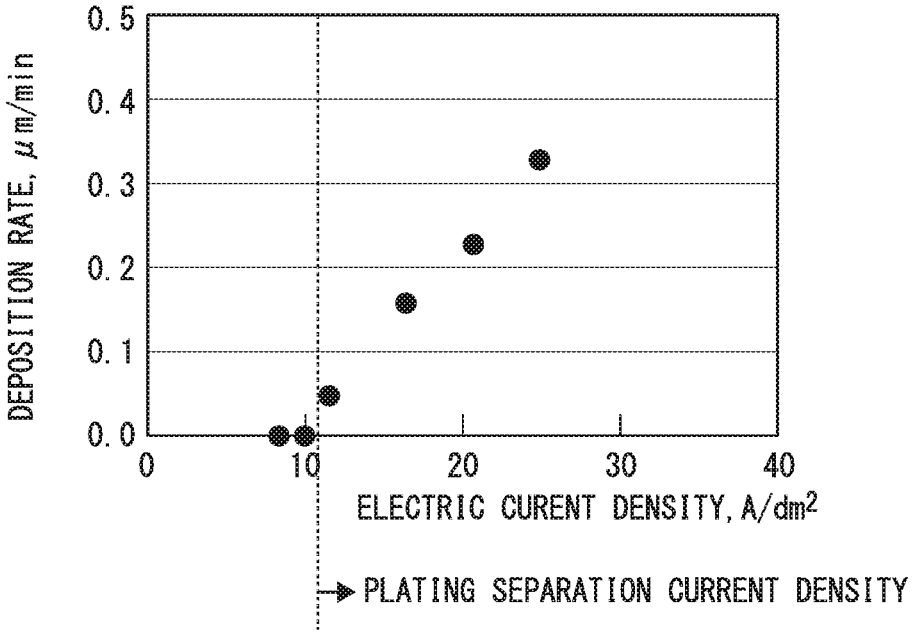
FIG. 8 is a graph illustrating an exemplification of a relationship between current density that is employed when the chromium plated parts in the example are produced and a deposition rate.

FIG. 8 shows a relationship between direct current density and chromium plating deposition rate in a case in which the pulse current is used. Although the deposition of the chromium plating did not advance at the current density from 0 to 10 A/dm$^2$, the deposition rate of the chromium plating rose at the timing at which the current density reached 12 A/dm$^2$.

Therefore, it was found that the superimposed current density that was indicated by a boundary value in a case of a change to the compressive residual stress values shown in FIG. 7 was current density at which the deposition rate of the chromium plating rose as shown in FIG. 8.

Therefore, it was found that a threshold value of the superimposed current to obtain the compressive residual stress values of 100 MPa or more for the chromium plating layers was a plating separation lower limit current density when the chromium plating was deposited.

Figure 9:
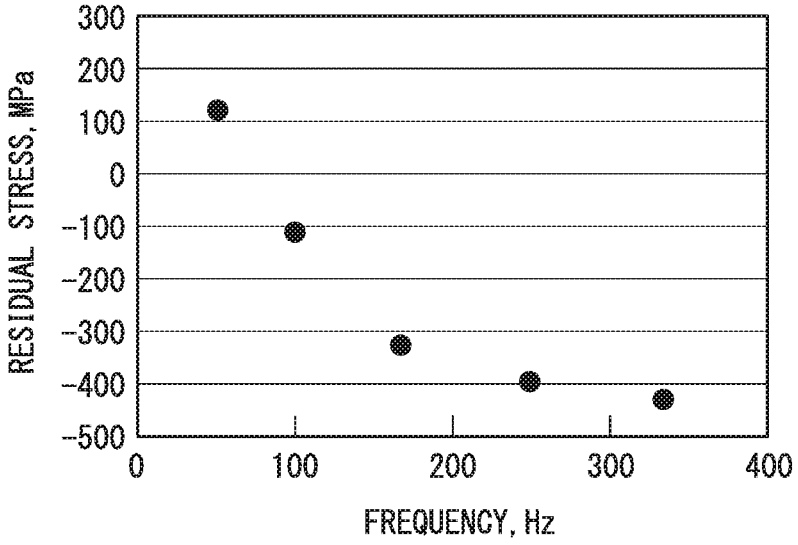
FIG. 9 is a graph illustrating an exemplification of a relationship between a frequency of a pulse current that is used when the chromium plated parts in the example are produced and residual stress of the obtained chromium plating layers.

FIG. 9 shows residual compressive stress values of the respective chromium plating layers obtained by setting the superimposed current density with respect to the pulse current to 21 A/dm$^2$ and setting a frequency of the pulse current to five values (50 Hz, 100 Hz, 167 Hz, 250 Hz, and 333 Hz) from 50 to 333 Hz.

In the case in which the frequency was 50 Hz, the relationship of the pulse conduction time/downtime was 10.0 ms/10.0 ms. In the case in which the frequency was 100 Hz, the relationship of the pulse conduction time/downtime was 5.0 ms/5.0 ms. In the case in which the frequency was 167 Hz, the relationship of the pulse conduction time/downtime was 3.0 ms/3.0 ms. In the case in which the frequency was 250 Hz, the relationship of the pulse conduction time/downtime was 2.0 ms/2.0 ms. In the case in which the frequency was 333 Hz, the relationship of the pulse conduction time/downtime was 1.5 ms/1.5 ms.

It was found that the compressive residual stress values of 100 MPa or more were able to be obtained for the chromium plating layers when the pulse frequency was set to 100 Hz or more.

Round bars with a size of ϕ12.5 mm (quenched and tempered material in accordance with JIS stipulation S25C) were used as workpieces. The workpieces were immersed in a plurality of plating baths in which chromic acid was contained at 298 g/L, a plurality of concentrations of sulfate radicals ($SO_4^{2-}$) from 3.0 to 7.0 g/L were set, and the content of the organic sulfonic acid was set to 5.5 g/L. The peak current density in the pulse electrolysis in these plating baths was set to 210 A/dm$^2$, the bath temperature was set to 75° C., and the pulse conduction time/downtime was set to 0.8 ms/0.3 ms (with no superimposition), or the pulse conduction time/downtime was set to 1.5 ms/0.9 ms (superimposed current density of 16 A/dm$^2$), and chromium plating layers with the thicknesses of 20 μm in which cracking was suppressed were deposited on the surfaces of the workpieces. Also, the residual stress values of the chromium plating layers were measured.

Figure 10:
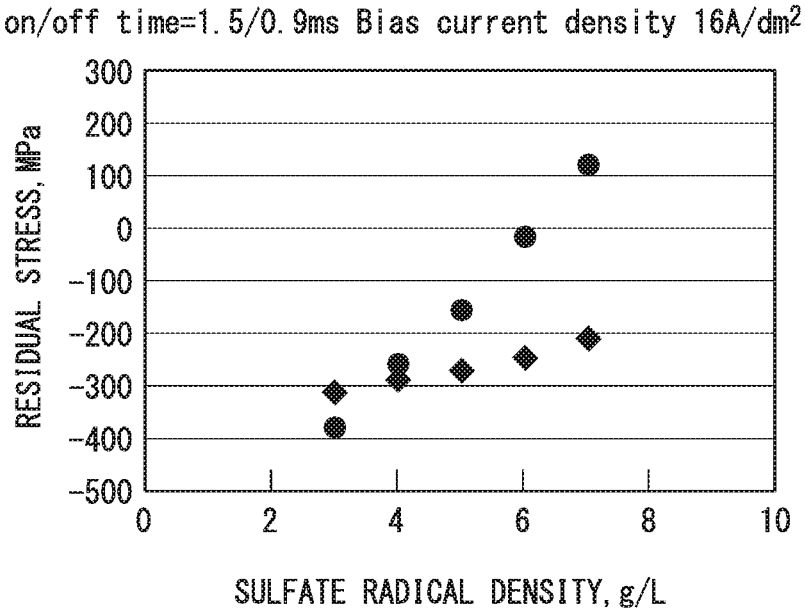
FIG. 10 is a graph illustrating an exemplification of a relationship between sulfate radical density of a plating bath that is used when the chromium plated parts in the example are produced and residual stress of the obtained chromium plating layers.

FIG. 10 shows a relationship between sulfate radicals ($SO_4^{2-}$) and the residual stress of the chromium plating layers.

It was found from the results shown in FIG. 10 that it was possible to reduce the amount of shift of the residual stress values of the chromium plating layers toward the tensile direction that accompanies the rise of the concentration of the sulfate radicals ($SO_4^{2-}$) to about ⅕ by superimposing the direct current on the pulse current. It was also possible to obtain the chromium plating layers that have the compressive residual stress of about −200 MPa even when the concentration of sulfate radicals ($SO_4^{2-}$) was 7.0 g/L.

Next, description will be given again of desirable ranges of the conduction time and the downtime to obtain the compressive residual stress values of 100 MPa or more for the chromium plating layers obtained in the case in which the conduction time (ms) and the downtime (ms) shown in FIG. 1 were adjusted, from among the results obtained in the previous example.

Figure 11:
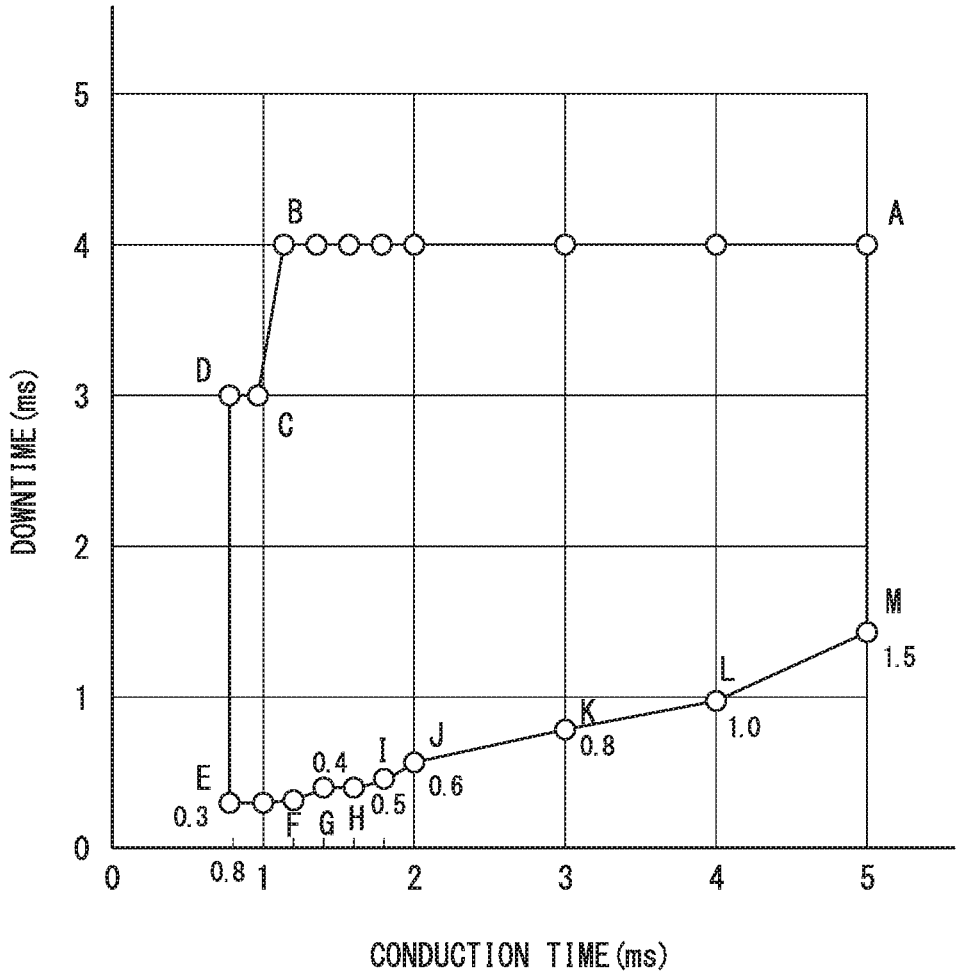
FIG. 11 is a graph illustrating desirable ranges of conduction time and downtime of a pulse current that are preferably used when the chromium plated parts in the example are produced.

FIG. 11 is a graph in which the conductive time shown in FIG. 1 is plotted on the horizontal axis and the downtime shown in FIG. 1 is plotted on the vertical axis, and the range in which the chromium plating layers with the compressive residual stress values of 100 MPa or more can be obtained in this graph is plotted out as follows.

In the graph in FIG. 11, the point corresponding to the conduction time of 5 ms and the downtime of 4 ms is defined as a point A, the point corresponding to the conduction time of 1.2 ms and the downtime of 4 ms is defined as a point B, the point corresponding to the conduction time of 1 ms and the downtime of 3 ms is defined as a point C, and the point corresponding to the conduction time of 0.8 ms and the downtime of 3 ms is defined as a point D.

In the graph in FIG. 11, the point corresponding to the conduction time of 0.8 ms and the downtime of 0.3 ms is defined as a point E, the point corresponding to the conduction time of 1.2 ms and the downtime of 0.3 ms is defined as a point F, the point corresponding to the conduction time of 1.4 ms and the downtime of 0.4 ms is defined as a point G, the point corresponding to the conduction time of 1.6 ms and the downtime of 0.4 ms is defined as a point H, and the point corresponding to the conduction time of 1.8 ms and the downtime of 0.5 ms is defined as a point I.

In the graph in FIG. 11, the point corresponding to the conduction time of 2 ms and the downtime of 0.6 ms is defined as a point J, the point corresponding to the conduction time of 3 ms and the downtime of 0.8 ms is defined as a point K, the point corresponding to the conduction time of 4 ms and the downtime of 1 ms is defined as a point L, and the point corresponding to the conduction time of 5 ms and the downtime of 1.5 ms is defined as a point M.

It was found from the results shown in FIG. 1 that if the pulse current that selects the relationship between the conduction time and the downtime selected within the range surrounded by the line segments coupling the respective points A, B, C, D, E, F, G, H, I, J, K, L, and M in the graph in FIG. 11 with the respective points defined as described above is used, and the electrolysis is performed by superimposing the direct current on the pulse current, it is possible to obtain the chromium plating layers with the compressive residual stress values of 100 MPa or more.

The method for producing chromium plated parts according to the embodiment can be defined as follows. That is, in the graph shown in FIG. 11 in which the horizontal axis represents the conduction time (ms) and the vertical axis represents the downtime (ms) in a case in which the conduction time of the pulse current is set in a range from 0.8 to 5 ms, the downtime of the pulse current is set in a range from 0.3 to 4 ms, the point corresponding to the conduction time of 5 ms and the downtime of 4 ms is defined as a point A, the point corresponding to the conduction time of 1.2 ms and the downtime of 4 ms is defined as a point B, the point corresponding to the conduction time of 1 ms and the downtime of 3 ms is defined as a point C, the point corresponding to the conduction time of 0.8 ms and the downtime of 3 ms is defined as a point D, the point corresponding to the conduction time of 0.8 ms and the downtime of 0.3 ms is defined as a point E, the point corresponding to the conduction time of 1.2 ms and the downtime of 0.3 ms is defined as a point F, the point corresponding to the conduction time of 1.4 ms and the downtime of 0.4 ms is defined as a point G, the point corresponding to the conduction time of 1.6 ms and the downtime of 0.4 ms is defined as a point H, the point corresponding to the conduction time of 1.8 ms and the downtime of 0.5 ms is defined as a point I, the point corresponding to the conduction time of 2 ms and the downtime of 0.6 ms is defined as a point J, the point corresponding to the conduction time of 3 ms and the downtime of 0.8 ms is defined as a point K, the point corresponding to the conduction time of 4 ms and the downtime of 1 ms is defined as a point L, and the point corresponding to the conduction time of 5 ms and the downtime of 1.5 ms is defined as a point M, the pulse current for which the conduction time and the down time selected within the range surrounded by the line segments connecting the respective points A, B, C, D, E, F, G, H, I, J, K, L, and M in the graph in FIG. 11 can be selected is used.

Similarly, the apparatus for producing chromium plated parts according to the embodiment can be defined as follows. That is, in the graph shown in FIG. 11 in which the horizontal axis represents the conduction time (ms) and the vertical axis represent the downtime (ms) in a case in which the conduction time of the pulse current applied from the pulsed power supply is set in a range from 0.8 to 5 ms, the downtime of the pulse current is set in a range from 0.3 to 4 ms for the apparatus for producing chromium plated parts according to the embodiment, the point corresponding to the conduction time of 5 ms and the downtime of 4 ms is defined as a point A, the point corresponding to the conduction time of 1.2 ms and the downtime of 4 ms is defined as a point B, the point corresponding to the conduction time of 1 ms and the downtime of 3 ms is defined as a point C, the point corresponding to the conduction time of 0.8 ms and the downtime of 3 ms is defined as a point D, the point corresponding to the conduction time of 0.8 ms and the downtime of 0.3 ms is defined as a point E, the point corresponding to the conduction time of 1.2 ms and the downtime of 0.3 ms is defined as a point F, the point corresponding to the conduction time of 1.4 ms and the downtime of 0.4 ms is defined as a point G, the point corresponding to the conduction time of 1.6 ms and the downtime of 0.4 ms is defined as a point H, the point corresponding to the conduction time of 1.8 ms and the downtime of 0.5 ms is defined as a point I, the point corresponding to the conduction time of 2 ms and the downtime of 0.6 ms is defined as a point J, the point corresponding to the conduction time of 3 ms and the downtime of 0.8 ms is defined as a point K, the point corresponding to the conduction time of 4 ms and the downtime of 1 ms is defined as a point L, and the point corresponding to the conduction time of 5 ms and the downtime of 1.5 ms is defined as a point M, the pulse current for which the conduction time and the downtime selected within the range surrounded by the line segments connecting the respective points A, B, C, D, E, F, G, H, I, J, K, L, and M in the graph in FIG. 11 can be selected is used.

INDUSTRIAL APPLICABILITY

According to the aforementioned method for producing chromium plated parts and chromium plating apparatus, it is possible to widen ranges of choice of conduction time and downtime of a pulse current when a chromium plating treatment is simultaneously performed on a plurality of workpieces in a chromium plating bath and chromium plating layers with compressive residual stress of 100 MPa or more are formed, as compared with the related art. As a result, it is possible to generate the chromium plating layers with targeted compressive residual stress with no cracking on all the plurality of workpieces.

The following aspects can be considered, for example, as the method for producing chromium plated parts and the chromium plating apparatus based on the aforementioned embodiment. According to a first aspect, a method for producing chromium plated parts includes a process of immersing a plurality of workpieces in a chromium plating bath; a process of performing a plating treatment by using a pulse current; and a deposit process of depositing chromium plating layers, which have compressive residual stress and suppressed cracking, on surfaces of the plurality of workpieces, and a direct current from a plating separation lower limit current density up to a range in which the chromium plating layers have compressive residual stress is superimposed during downtime of application of the pulse current.

According to a second aspect, the current density in which the chromium plating layers have the compressive residual stress having a range from the plating separation lower limit current density to not more than 25 A/dm$^2$ in the first aspect.

According to a third aspect, the DC superimposed current density has a range from 10 to 35 A/dm$^2$ in the first aspect.

According to a fourth aspect, a frequency of the pulse current is from 100 to 700 Hz in the first to third aspects.

According to a fifth aspect, the plurality of workpieces are immersed in the chromium plating bath in an aligned state, and the individual workpieces are energized by corresponding cathode electrodes and energized by anode electrodes that are individually arranged in the vicinity of the individual workpieces in the first to fourth aspects.

According to a sixth aspect, a chromium plating apparatus includes a treatment tank that accommodates a chromium plating bath; cathode electrodes that energize workpieces made of a metal while the workpieces are suspended in the treatment tank; anode electrodes that are arranged in the vicinity of the workpieces that are suspended in the treatment tank; and a pulsed power supply that is connected to the cathode electrodes and the anode electrodes and applies a pulse current thereto. The pulsed power supply superimposes a direct current from a plating separation lower limit current density up to a range in which compressive residual stress is obtained during downtime of the pulse current.

According to a seventh aspect, the pulsed power supply applies, to the pulse current, current density from the plating separation lower limit current density to not more than 25 A/dm$^2$ as the current density up to the range in which the compressive residual stress is obtained in the sixth aspect.

According to an eighth aspect, the pulsed power supply selects a range from 10 to 35 A/dm$^2$ as the DC superimposed current density in the sixth to seventh aspects.

According to a ninth aspect, the pulsed power supply selects a range from 100 to 700 Hz as a frequency of the pulse current in the sixth to eighth aspects.

According to a tenth aspect, the plurality of cathode electrodes are installed in the treatment tank to immerse a plurality of workpieces in the chromium plating bath in an aligned state, the plurality of anode electrodes are installed to correspond to the individual workpieces in the treatment tank, the cathode electrodes are connected to a pulsed power supply via an anode support and an anode-side bus bar, and the anode electrodes are connected to the pulsed power supply via a cathode support and a cathode-side bus bar in the sixth to ninth aspects.

REFERENCE SIGNS LIST

1 Chromium plating apparatus
2 Treatment tank
3 Pulsed power supply
6 Anode support
7 Anode-side bus bar
15 Cathode support
16 Cathode-side bus bar
W (W1 to W10) Workpiece
S Chromium plating layer
Y Anode electrode
X Cathode electrode

The invention claimed is:

1. A method for producing chromium plated parts comprising the steps of:

immersing a plurality of workpieces in a chromium plating bath;

performing a plating treatment by application of a pulse current; and depositing chromium plating layers, which have a compressive residual stress, on surfaces of the plurality of workpieces, wherein a direct current from a plating separation lower limit current density up to a range in which the chromium plating layers have the compressive residual stress is applied only during a downtime of the application of the pulse current, the direct current (DC) being greater than zero ampere, and wherein the pulse current is caused to pass through a high-pass filter that allows only a pulse waveform to pass therethrough and the direct current is caused to pass through a low-pass filter that allows only a DC waveform to pass therethrough, and both the pulse current and the direct current are then synthesized, wherein a pulse waveform shape that prevents a reverse flow of mutual electric currents is adjusted by a pulsed power supply device, and wherein the direct current is adjusted by a DC power supply device to be applied during the downtime of the application of the pulse current.

2. The method for producing chromium plated parts according to claim 1, wherein a current density in which the chromium plating layers have the compressive residual stress has a range from the plating separation lower limit current density to not more than 25 $A/dm^2$.

3. The method for producing chromium plated parts according to claim 1, wherein the DC current density has a range from 10 to 35 $A/dm^2$.

4. The method for producing chromium plated parts according to claim 1, wherein a frequency of the pulse current is from 100 to 700 Hz.

5. The method for producing chromium plated parts according to claim 1, wherein the plurality of workpieces are immersed in the chromium plating bath in an aligned state, and the individual workpieces are energized by corresponding cathode electrodes and energized by anode electrodes that are individually arranged in the vicinity of the individual workpieces.

6. The method for producing chromium plated parts according to claim 1, wherein the downtime of the application of the pulse current is in a range from 0.3 ms to 5 ms in a case in which a conduction time of the application of the pulse current is in a range from 0.8 ms to 5 ms.

* * * * *